US008212673B1

(12) United States Patent
Whittaker

(10) Patent No.: US 8,212,673 B1
(45) Date of Patent: Jul. 3, 2012

(54) CONDITION-BASED MAINTENANCE SYSTEMS AND METHODS

(75) Inventor: Glen E. Whittaker, Florissant, MO (US)

(73) Assignee: The Boeing Company, Chicago, IL (US)

( * ) Notice: Subject to any disclaimer, the term of this patent is extended or adjusted under 35 U.S.C. 154(b) by 1371 days.

(21) Appl. No.: 11/773,371

(22) Filed: Jul. 3, 2007

(51) Int. Cl.
*G08B 13/14* (2006.01)

(52) U.S. Cl. ..... 340/572.1; 340/5.92; 340/971

(58) Field of Classification Search .... 340/572.1–572.9, 340/945, 5.92, 961, 963, 971
See application file for complete search history.

(56) References Cited

U.S. PATENT DOCUMENTS

| | | | | |
|---|---|---|---|---|
| 5,331,579 | A * | 7/1994 | Maguire et al. | 703/2 |
| 5,974,349 | A * | 10/1999 | Levine | 701/29 |
| 6,618,654 | B1 * | 9/2003 | Zaat | 701/29 |
| 2004/0039502 | A1 * | 2/2004 | Wilson et al. | 701/29 |
| 2005/0212675 | A1 * | 9/2005 | Green | 340/572.8 |
| 2006/0055564 | A1 | 3/2006 | Olsen et al. | |
| 2006/0248182 | A1 * | 11/2006 | Glassco et al. | 709/223 |
| 2007/0112488 | A1 | 5/2007 | Avery et al. | |
| 2007/0114280 | A1 * | 5/2007 | Coop et al. | 235/385 |

FOREIGN PATENT DOCUMENTS

WO WO2004013785(A2) 2/2004

OTHER PUBLICATIONS

U.S. Appl. No. 11/473,418, filed Jun. 22, 2006, Balestra, "System and Method for Determining Fatigue Life Expenditure of a Component."

* cited by examiner

*Primary Examiner* — Daniel Previl
(74) *Attorney, Agent, or Firm* — Caven & Aghevli LLC

(57) ABSTRACT

Systems and methods are described for condition-based maintenance of mechanical systems. In one embodiment, a method for performing condition-based maintenance on a mechanical system includes providing a radio frequency identifier (RFID) tag on a component of the mechanical system, sensing one or more operating conditions during operation of the mechanical system, calculating a service life increment of the component based on the one or more operating conditions, and adjusting a service life value stored on the RFID tag. After operation of the mechanical system has ceased, the method includes scanning the service life value stored on the RFID tag, and determining whether at least one of an inspection, a maintenance, and a repair of the component is needed based on the service life value. The mechanical system may be an aircraft, and the operating conditions may include aerodynamic conditions, loads, accelerations, and movements of the aircraft during flight.

19 Claims, 4 Drawing Sheets

CONDITION-BASED MAINTENANCE SYSTEMS AND METHODS

FIELD OF THE INVENTION

The field of the present disclosure relates to maintenance of equipment, and more specifically, to systems and methods for condition-based maintenance of equipment such as aircraft and other vehicles, and any other suitable mechanical systems.

BACKGROUND

The service life of a vehicle or other mechanical system may be determined by a component that has the earliest predicted time to failure. For vehicles (e.g. aircraft), such predictions have typically been estimated based on service use times and archived historical failure rates for a respective component family, with significant time-to-failure buffers added. Advanced service life measurement systems (SLMS) and methods for determining remaining service life of aircraft (and other vehicles) are disclosed, for example, in U.S. Pat. No. 6,618,654 issued to Stephen V. Zaat. Life cycle determinations based on service use times and historical failure rates, however, may result in premature retirement of a given component, and consequently, premature retirement of a vehicle, manufacturing assembly, or mechanical system. Similarly, maintenance inspections for critical components are typically scheduled based on flight hours, and actual service life data are typically not available to the maintenance system.

SUMMARY

The present disclosure is directed to systems and methods for condition-based maintenance. Techniques in accordance with the present disclosure may advantageously provide the opportunity to increase the accuracy of life expenditure information for monitored components of mechanical systems, may prevent premature retirement of a given component or system, and may facilitate improved reuse and interchanging of components in condition-based maintenance environments.

In one embodiment, a method for performing condition-based maintenance on a mechanical system includes providing a radio frequency identifier (RFID) tag on a component of the mechanical system; sensing one or more operating conditions during operation of the mechanical system; calculating a service life increment of the component based on the one or more operating conditions; adjusting a service life value stored on the RFID tag of the components corresponding to the calculated service life increment; after operation of the mechanical system has ceased, scanning the service life value stored on the RFID tag; and determining whether at least one of an inspection, a maintenance, and a repair of the component is needed based on the service life value. In further embodiments, the mechanical system may be an aircraft, and the operating conditions may include aerodynamic conditions, loads, accelerations, and movements of the aircraft during flight.

In another embodiment, a mechanical system includes a plurality of components operatively coupled to perform a desired operation; a plurality of radio frequency identifier (RFID) tags, each RFID tag being affixed to a corresponding one of the plurality of components; a measurement system configured to sense one or more operating conditions of the mechanical system; and an onboard system in operative communication with the plurality of measurement devices. The onboard system includes an RFID interface component configured to communicate radio frequency (RF) signals with the plurality of RFID tags, and a processor configured to receive a Life cycle value for each of the plurality of components from the RFID interface, and to receive the one or more operating conditions sensed by the measurement system. The processor is further configured to execute instructions to calculate a Life cycle increment for each of the plurality of components based on the one or more operating conditions; adjust the Life cycle value of each of the plurality of components; and store the adjusted Life cycle value on the corresponding RFID tag for each of the plurality of components via the RFID interface component.

The features, functions, and advantages that have been discussed can be achieved independently in various embodiments of the present invention or may be combined in yet other embodiments further details of which can be seen with reference to the following description and drawings.

BRIEF DESCRIPTION OF THE DRAWINGS

Embodiments of systems and methods in accordance with the teachings of the present disclosure are described in detail below with reference to the following drawings.

DETAILED DESCRIPTION

The present disclosure teaches systems and methods for condition-based maintenance. Many specific details of certain embodiments of the invention are set forth in the following description and in FIGS. 1-6 to provide a thorough understanding of such embodiments. One skilled in the art, however, will understand that the invention may have additional embodiments, or that the invention may be practiced without several of the details described in the following description.

In general, embodiments of condition-based maintenance systems, or service life measurement systems (SLMS), in accordance with the present disclosure may include a modular onboard system that can continuously (or nearly continuously) collect Life cycle determinant data from one or more sensors distributed on various parts (or components) of a mechanical system (e.g. a vehicle). The Life cycle determinant data are recorded during operation of the mechanical system, and therefore, may be based on actual operating conditions. The Life cycle determinant data are then converted into values representing service-life-remaining for both the parts and the mechanical system as a whole. The condition-based maintenance system may provide inherent redundancy for storage of the service-life-remaining value(s) through simultaneous transmission and collection at the discrete part level and the on-ground service level. Embodiments of systems and methods in accordance with the present disclosure may therefore provide improved Life cycle determinations, and more efficient condition-based maintenance, in comparison with the prior art.

Figure 1:
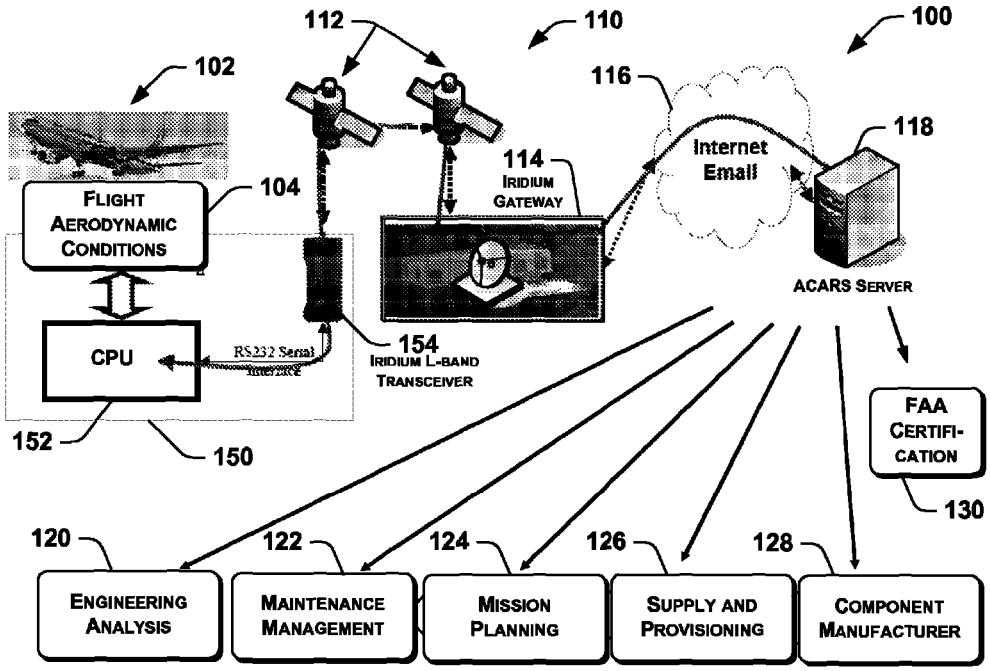
FIG. 1 is an exemplary environment for implementing techniques for condition-based maintenance in accordance with the present disclosure.

FIG. 1 is an exemplary environment 100 for implementing techniques for condition-based maintenance in accordance with the present disclosure. In this embodiment, an aircraft 102 includes an onboard system 150 configured to receive Life cycle determinant data from onboard sensors distributed on various parts throughout the aircraft 102. A processor 152 of the onboard system 150 receives flight condition data 104 from various onboard systems during actual operations of the aircraft 102. A communication component 154 operatively communicates the Life cycle determinant data from the onboard system 150 to a global data transmission system 110. In some embodiments, the communication component 154 may be an Iridium L-band transceiver component.

In the embodiment shown in FIG. 1, the global data transmission system 110 includes a plurality of satellites 112 configured to receive signals from the onboard system 150, and a ground facility 114 that receives the Life cycle determinant data from the plurality of satellites 112. A communication network 116 couples the ground facility 114 to a Life cycle server 118 that is configured to receive, manipulate, convert, and analyze the Life cycle determinant data, as described more fully below. In some embodiments, the Life cycle server 118 is configured as an Aircraft Communication Addressing and Reporting System (ACARS) server. In turn, the Life cycle server 118 may make the Life cycle determinant data available to a variety of parties, such as an engineering organization 120, a maintenance management organization 122, a mission planning organization 124, a supply and provisioning organization 126, a component manufacturer 128, or any other suitable party or organization. The Life cycle determinant data may also be made available to a certification authority 130, such as the U.S. Federal Aviation Administration (FAA). In some embodiments, embodiments of systems and methods in accordance with the present disclosure may extend (or otherwise revise) a maintenance interval of one or more components of a mechanical system (e.g. the aircraft 102), and may require approval by the certification authority 130 of the new intervals.

The onboard sensors located throughout the aircraft 102 may include radio frequency identifier (RFID) sensors (or tags). As used herein, the term RFID may include any type of device that operates using radio frequency (RF) signals as an information storage mechanism, and may be referred to using a variety of terms, including tag, transponder, electronic label, code plate, bar code, and various other terms. Although transponder may technically be the most accurate, the term most commonly used for these devices throughout this application is the term "tag."

As described more fully below, data may be contained on the RFID tag in one or more bits for the purpose of providing identification and other information relevant to the component to which the RFID tag is attached. Such RFID devices may incorporate the use of electromagnetic or electrostatic coupling in the radio frequency portion of the spectrum to communicate to or from an RFID tag through a variety of modulation and encodation schemes. For example, in some embodiments, techniques disclosed herein may be used in association with RFID tags that comply with Electronic Product Code (EPC) standards and specifications, such as those RFID tags commercially available from Remote Identity, LLC of Erie, Colorado, or any other suitable supplier.

Figure 2:
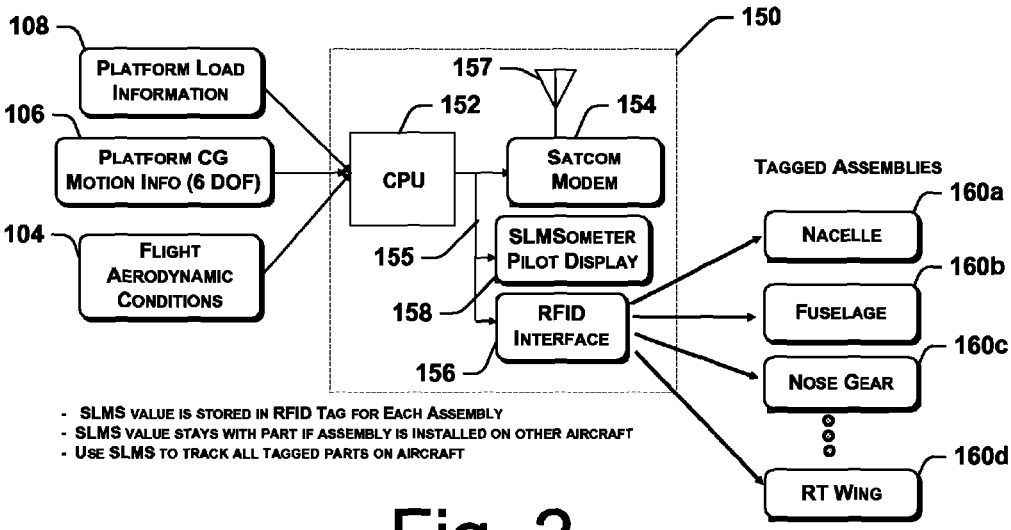
FIG. 2 is an embodiment of an onboard system for condition-based maintenance suitable for use in the environment of FIG. 1.

FIG. 2 is an enlarged schematic view of an embodiment of the onboard system 150 suitable for use in the environment 100 for condition-based maintenance of FIG. 1. As noted above, the onboard system 150 includes the processor 152 coupled to receive flight aerodynamic conditions 104 from the aircraft 102. Six degree-of-freedom (DOF) motion information 106 of the center-of-gravity (CG) of the aircraft 102, as well as load information 108, is also transmitted to the processor 152. These data may be provided, for example, using accelerometers, strain (or stress) gauges, navigational devices, or other known measurement devices.

An RFID interface 156 of the onboard system 150 operatively communicates with RFID tags 160 located on various components of the aircraft 102. For example, the aircraft 102 may include a nacelle tag 160*a*, a fuselage tag 160*b*, a nose gear tag 160*c*, a right wing tag 160*d*, and other tags situated on other components of the aircraft 102. The information received by the RFID interface 156 may be communicated to the other components of the onboard system 150 (e.g. the processor 152) via a bus 155. The Life cycle determinant data may be transmitted by the communications component 154 to the global data transmission system 110 by means of an antenna 157. If desired, the Life cycle determinant (or SLMS) data may also be provided to a crew member of the aircraft 102 via a display 158.

Each RFID tag 160 includes service life (or Life cycle) information associated with the corresponding component to which it is attached. The service life information may include a remaining service life value that may be determined or predicted based on the actual operating conditions (e.g. loads, movements, operating conditions, etc) experienced by the corresponding component. The RFID tag 160 may remain with each component, even if it is removed, serviced, and re-installed on another aircraft.

More specifically, the RFID interface 156 may receive the remaining service life information from each component and provide this information to the processor 152. Similarly, the processor 152 may receive information regarding the various operating conditions 104, 106, 108 of the aircraft 102. Using these data, the processor 152 may compute an incremental adjustment (or decrease) of the remaining service life of each component based on the actual operating conditions. The processor 152 may provide this information back to the RFID interface 156, which in turn may update the RFID tags 160 with the adjusted remaining service life values. The processor 152 may also provide the information to the communication component 154, which may transmit at least some of the information (e.g. operating condition information and remaining Life cycle information) via the global data transmission system 110 for further analysis and storage by an ACARS Server which is used as a maintenance data system.

In alternate embodiments, the onboard system 150 may simply gather the desired information (e.g. operating condition information and remaining Life cycle information) and transmit this information to the global data transmission system 110. The global data transmission system 110 may then compute incremental adjustments of the remaining service life of the components of the aircraft 102. The monitoring system 110 may transmit this service life adjustments back to the onboard system 150 for updating the RFID tags 160, or alternately, the RFID tags 160 may be provided with updated service life information at a later time, such as during routine post-flight ground operations.

In some embodiments, when a component is serviced or refurbished, the remaining service life (or Life cycle) value on the RFID tag 160 may be adjusted (increased or decreased) by a technician or other ground personnel based on the actual condition of the component. Thus, the RFID information from all of the RFID tags 160 on the aircraft 102 may be analyzed and used to determine an actual usage-based service life condition of the aircraft 102, and to determine requirements for performing condition-based maintenance on the aircraft 102.

The incremental changes in remaining service life may be calculated using any suitable analytical or empirical techniques. For example, in a presently preferred embodiment, the remaining service life calculations are performed using an inverse Modified Universal Slopes Equation (iMUSE) technique of the type disclosed in co-pending, commonly-owned U.S. patent application Ser. No. 11/473,418 entitled "System and Method for Determining Fatigue Life Expenditure of a Component" by Chester L. Balestra, which application is incorporated herein by reference. In brief, such iMUSE techniques determine a fractional fatigue life of a component having a known fatigue life, and provide information indicative of a remaining fatigue life (or service life) of the component.

More specifically, in one embodiment the onboard system 150 receives stress/strain amplitude values from one or more sensors located on or adjacent to the component being monitored. The onboard system 150 analyzes and sorts the maxima and minima amplitude values received from the sensors and generates a plurality of amplitude range values. The processor 152 uses the amplitude range values and known information on the fatigue life of the component being monitored to generate information indicative of the fractional life expended used during a given stress/strain cycle. The fractional fatigue life information is summed in an accumulator, and an output of the accumulator is fed into a summing circuit together with information pertaining to the known remaining fatigue life of the component at the start of an operating session. The summing circuit generates an output indicative of the remaining fatigue life of the component.

In further embodiments, the onboard system 150 may operate in connection with a clock circuit and generates amplitude stress/strain range values for each clock cycle that the clock provides. The onboard system 150 may also generate information indicating whether a particular amplitude range value is representative of a full cycle or a half cycle of amplitude stress/strain values, as well as whether or not no amplitude stress/strain values were generated for a given clock cycle. The processor 152 may use an iMUSE technique for determining the fractional life expenditure, per clock cycle, of the component. In one embodiment, the onboard system 150 may be configured to use a well-known rain flow sorting and counting algorithm for sorting the amplitude maxima and minima values from the sensors to generate the amplitude stress/strain range values to produce full cycles and half cycles of amplitude range values.

Thus, the onboard system 150 enables the remaining service life of a component to be monitored and tracked, in substantially real time. In addition, a continuously updated value of the remaining service life of each component may be generated and stored on the RFID tag 160 associated with each component. Analysis of the RF signals from the RFID tags 160 enable repair and maintenance personnel to scan and analyze the condition of each component, and to perform condition-based maintenance activities on each component based on actual operating conditions experienced by the components of the aircraft 102 or other mechanical system.

Figure 3:
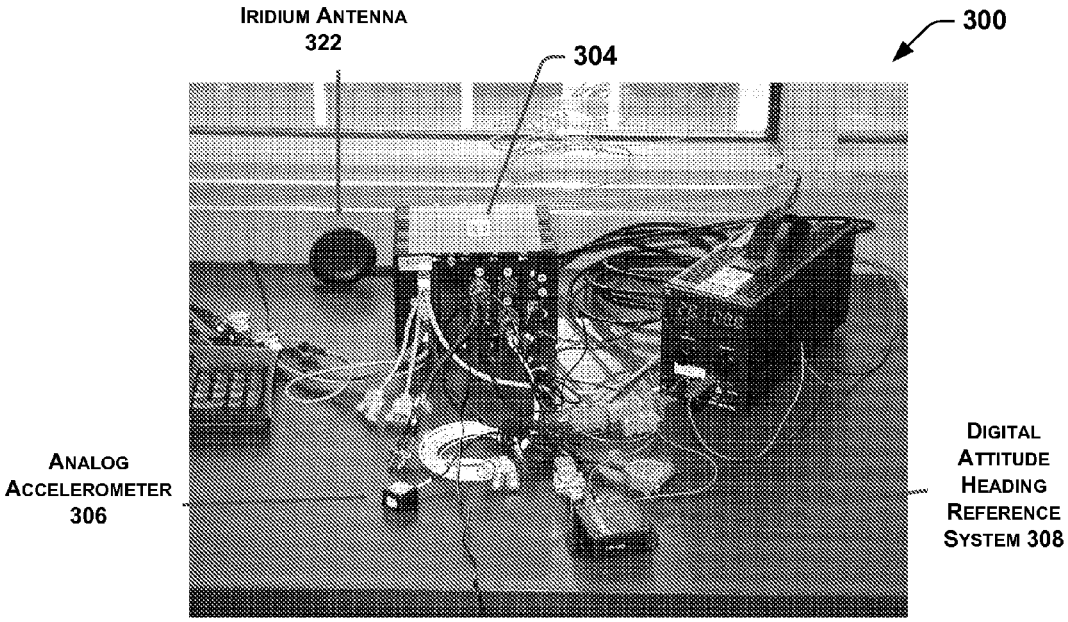
FIG. 3 is an isometric view of the onboard system of FIG. 2.
Figure 4:
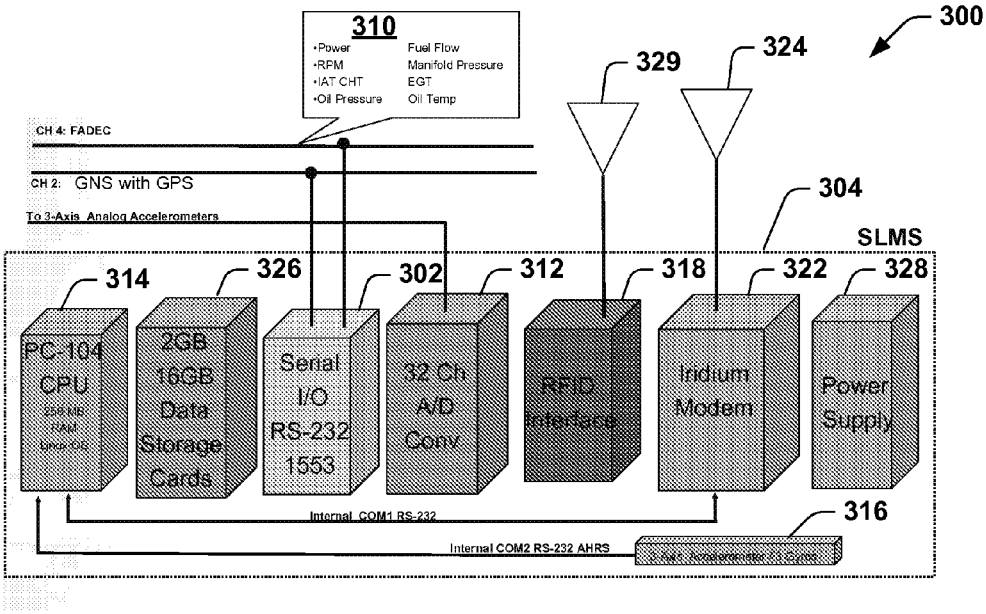
FIG. 4 is a block diagram of an onboard system in accordance with an alternate embodiment of the present disclosure.

FIGS. 3 and 4 are isometric and block diagrammatic views, respectively, of another embodiment of an onboard system 300 that may be used in a condition-based maintenance system in accordance with the present disclosure. In this embodiment, the onboard system 300 includes an input/output (I/O) component 302 disposed within a housing 304 and coupled to one or more sources of operating conditions of a mechanical system (e.g. aircraft or other vehicle). For example, in some embodiments, the I/O component 302 is coupled to a source of aerodynamic flight conditions 104, a source of movement information 106, and a source of loads information 108 (FIG. 2). In particular embodiments, the source of movement information 106 may include a global positioning system (GPS) or a guidance and navigation system (GNS). Similarly, an analog to digital (A/D) converter 312 of the onboard system 300 is coupled to receive outputs from one or more sources of information, such as movement information provided by analog accelerometers.

As shown in FIG. 3, the sources of information for the onboard system 300 may also include an analog accelerometer 306 and a digital attitude reference system 308. Other information 310 received by the I/O component 302 may include, for example, power setting, fuel flow rate, engine rotational velocity (RPM), manifold pressure, inlet air temperature, cylinder head temperature, exhaust gas temperature, oil pressure, oil temperature, and any other desired operating information.

A processor 314 (FIG. 4) is coupled to the I/O component 302 and to a GNS 316. In a particular embodiment, the GNS 316 includes a three axis accelerometer and three gyroscopic devices that provide six degree of freedom motion information. An RFID interface 318 includes an input device (e.g. antenna) 329 configured to receive RF signals from the various RFID tags 160 (FIG. 1) situated on the components of the mechanical system. Similarly, a data transmission component 322 (e.g. an Iridium modem) includes an antenna 324 that is configured to communicate with a ground system, such as the global data transmission system 110 of FIG. 1. In this embodiment, the onboard system 300 further includes a memory 326 and a power supply 328, providing data storage and power to the processor 314 and other components of the onboard system 300 as needed.

Generally, program modules executed on the processor 314 of the onboard system 300 may include routines, programs, objects, components, data structures, etc., for performing particular tasks as described herein. Typically, the functionality of the program modules may be combined or distributed as desired in various implementations.

An implementation of these modules and techniques may be stored on or transmitted across some form of computer-readable media. Computer-readable media can be any available media that can be accessed by a computer. By way of example, and not limitation, computer-readable media may comprise computer storage media that includes volatile and non-volatile, removable and non-removable media implemented in any method or technology for storage of information such as computer-readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium, including paper, punch cards and the like, which can be used to store the desired information and which can be accessed by a computer.

Figure 5:
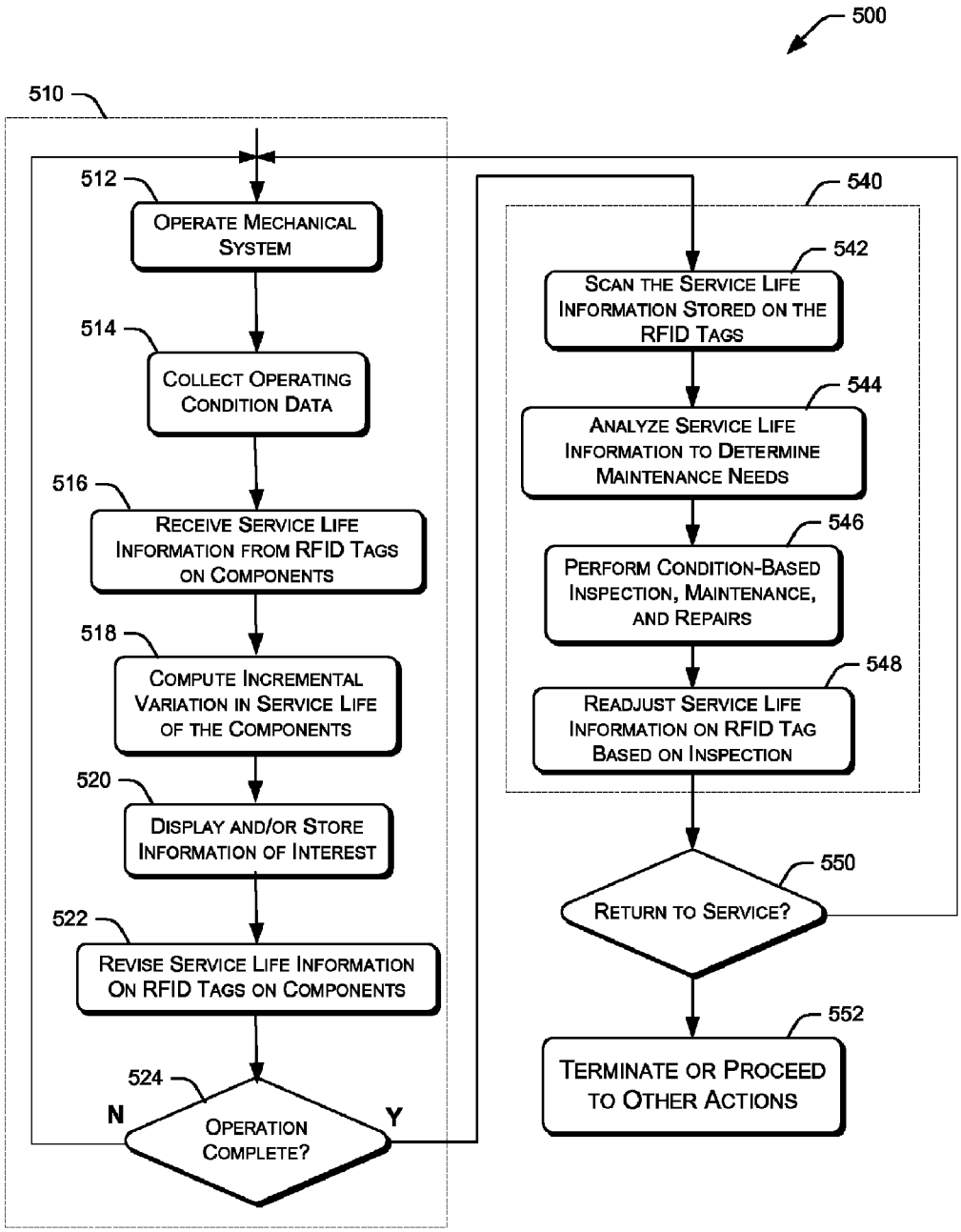
FIG. 5 is a flow diagram of a method of condition-based maintenance in accordance with another embodiment of the present disclosure.

FIG. 5 is a flow diagram of a method 500 of performing condition-based maintenance in accordance with another embodiment of the present disclosure. The method 500 is illustrated as a collection of blocks in a logical flow graph, which represents a sequence of operations that can be implemented in hardware, software, or a combination thereof. In the context of software, the blocks represent computer instructions that, when executed by one or more processors, perform the recited operations. For discussion purposes, the method 500 is described with reference to the exemplary components described above with reference to FIGS. 1 through 4.

As shown in FIG. 5, in this embodiment, the method 500 includes an operations portion 510 and a maintenance portion 540. The operations portion 510 includes operating the aircraft or other mechanical system at 512. During operation of the mechanical system, data regarding the operating conditions (e.g. loads, accelerations, aerodynamic conditions, RPM's, stresses/strains, etc.) experienced by the mechanical system are collected and provided to the onboard system 150 at 514. At 516, Service Life information is received by an RFID interface component of the onboard system from one or more RFID tags located on various components of the mechanical system. The Service Life information includes a remaining Life cycle (or service life) information corresponding to each of the various components.

At 518, the method 500 determines the incremental variation in remaining service life of each of the monitored components based on the actual operating conditions experienced by the components. As noted above, the incremental variations may be computed by the onboard system or by an external monitoring system (e.g. the global data transmission system 110). In particular embodiments, the incremental variations in service life may be calculated using an iMUSE technique. At 520, information of interest (e.g. Life cycle determinant data, remaining service life information, etc.) may be displayed to an operator of the mechanical system for analysis, or to warn of the operator of service life levels that fall below desired thresholds, or may be stored for subsequent analysis and record keeping.

The method 500 revises the Service Life information stored on each of the RFID tags 160 on the monitored components to reflect the incremental adjustments in remaining service life at 522. Alternately, the incremental adjustments may be stored (e.g. within an accumulator circuit or a memory of the onboard system 150), and the Service Life information on the RFID tags 160 may be updated at a later time. At 524, a determination is made whether operations of the mechanical system are complete. If not, the method 500 returns to operating the mechanical system at 512, and the above-described operations are repeated. In some embodiments, the updating of the Service Life information stored on the RFID tags 160 (at 522) is performed after it is determined that operation of the mechanical system is complete (at 524).

When operation of the mechanical system is complete (at 524), the method 500 may proceed to the maintenance portion 540. At 542, the Service Life information on the RFID tags may be read or scanned, and the Service Life information is analyzed at 544 to determine the maintenance needs of the monitored components. At 546, condition-based inspections, maintenance, and repairs of the components may be performed as needed based on the Service Life information from the RFID tags.

It will be appreciated that some components (e.g. flight control surfaces) may have experienced greater use during a particular operating period than other components (e.g. landing gear), and thus, may have experienced comparatively greater reductions in their remaining service life, or may require a correspondingly greater amount of maintenance. Similarly, the particular operating conditions experienced by the components of the mechanical system during a particular period of operation (e.g. unusually large landing gear impacts during landings by a less-experienced pilot, or by a former naval aviator accustomed to carrier landings) may be revealed by the analysis of the Service Life information on the RFID tags at 544, and maintenance and repairs may be conducted accordingly. The condition-based inspections, maintenance, and repairs of the components performed at 546 based on the Service Life information from the RFID tags may adequately account for such considerations and variables.

As noted above, it is possible that inspection of the components (at 546) may reveal that a particular component is resisting wear (or holding up) better than anticipated by the calculations (at 518). If so, then the remaining service life of such a component may be re-adjusted (increased), and the updated value stored on the corresponding RFID tag at 548 to provide a more accurate indication of the remaining Life cycle of the component.

At 550, the method 500 determines whether it is time to return the mechanical system to service. If so, the method 500 returns to operating the mechanical system at 512 and the above-described activities are repeated. Alternately, the method 500 terminates or proceeds to other actions at 552.

Embodiments of systems and methods in accordance with the present disclosure may provide multiple advantages over current methodologies. First, collecting and tracking actual condition-based information provides the opportunity to significantly increase the accuracy of life expenditure information for monitored parts and vehicles (and mechanical systems), and consequently preventing premature retirement of a given part or vehicle. Second, storage of the life expenditure values on-board discrete parts facilitates better reuse and interchanging of parts in condition-based maintenance environments. Third, systems in accordance with the present disclosure may not require installation of new sensors within a vehicle or mechanical system, but rather, only require placement of RFID tags on the monitored components, thus reducing cost and implementation time. Finally, the modular design of systems in accordance with the present disclosure provides an opportunity to incorporate added functionality that can utilize the base system capabilities as desired.

Figure 6:
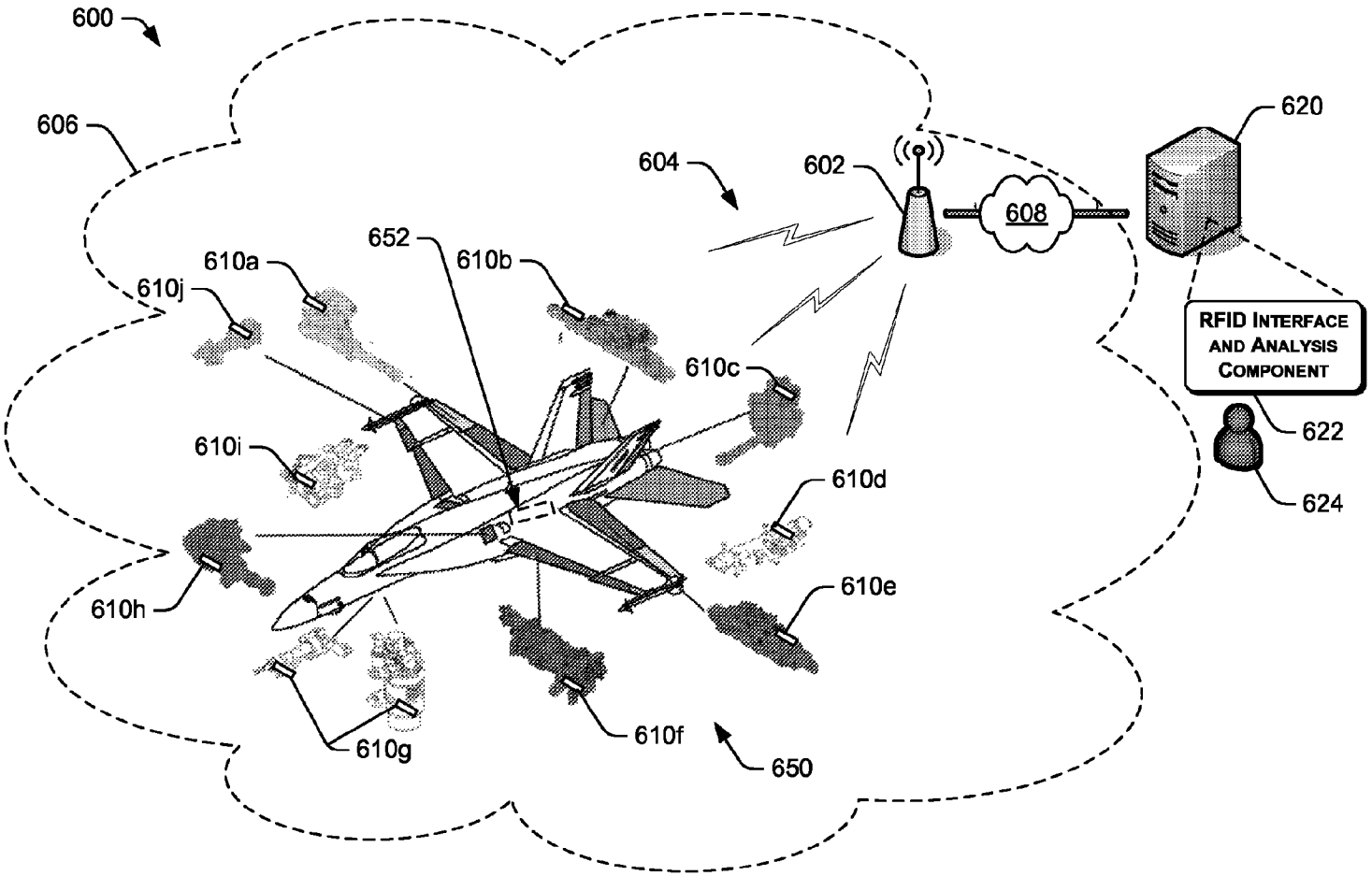
FIG. 6 is a schematic view of another exemplary environment for implementing techniques in accordance with the present disclosure.

It will be appreciated that alternate embodiments of systems and methods in accordance with the present disclosure may be conceived, and the invention is not limited to the particular embodiments described above with respect to FIGS. 1 through 5. For example, FIG. 6 is a schematic view of an exemplary ground-based environment 600 for implementing techniques in accordance with the present disclosure. The ground-based environment 600 may be a hangar, a maintenance depot, or other suitable facility configured for maintenance and repair of vehicles, including aircraft. It will be appreciated that at least some of the components of the ground-based environment 600 are substantially similar to the corresponding components described above, and for the sake of brevity, a description of such similar components will not be repeated.

In this embodiment, the ground-based environment 600 includes an RFID reader 602 configured to receive RF signals 604 from one or more RFID tags 610 disposed within a detection region 606. The term "RFID reader" is intended to include any device that receives RF signals from the RFID tag 610. The RFID reader 602 may extract and separate information from the RFID signals 604, including differentiating between different RFID tags 610. In some embodiments, the RFID reader 602 includes a transmitter/receiver pair (or transceiver) that is configured to both receive and transmit RF signals to the RFID tags 610.

The RFID reader 602 transmits the information extracted from the RF signals 604 via one or more networks 608 to a platform 620. The platform 620 may be implemented in any number of suitable ways, including as a server, a desktop computing device, a mainframe, a cluster, a portable computer, or any other suitable computing device. An RFID interface and analysis component 622 is operatively installed on the platform 620 to enable proper communication with the RFID tags 610, and analysis of the Service Life information 604.

In operation, an aircraft 650 may be positioned within the detection region 606 for condition-based inspection, maintenance, and repairs. The aircraft 650 includes an onboard system 652 having the capabilities described above (e.g. onboard systems 150, 300 of FIGS. 1 and 3), and is equipped with a plurality of RFID tags 610. For example, the aircraft 650 may include the following RFID tags 610: an aileron servocylinder tag 610*a*, a stabilator servocylinder tag 610*b*, a rudder servocylinder tag 610*c*, a rudder switching valve tag 610, a trailing edge flap servocylinder tag 610*e*, a leading edge servovalve tag 610*f*, one or more nose gear tags 610*g*, a spoiler actuator tag 610*h*, an aileron switching valve tag 610*i*, and a leading edge flap asymmetry control tag 610*j*. Of course, many other RFID tags 610 may also be provided.

As described above, the aircraft 650 may have been operated for a period of time such that the Life cycle information stored on the RFID tags 610 associated with the various components have been incrementally updated during flight in accordance with actual operating conditions of the aircraft 650 (e.g. loads, accelerations, aerodynamic conditions, RPM's, stresses/strains, etc.), such as described by the operating portion 510 of the method 500 of FIG. 5.

In the ground-based environment 600, those activities associated with condition-based maintenance (e.g. maintenance portion 540 of the method 500 of FIG. 5) described above may be performed. More specifically, the RFID reader 602 may receive the RF signals 604 from the RFID tags 610, and communicate this information to the platform 620. The RFID interface and analysis component 622 may be operated by a technician 624 (e.g. via a user interface) to analyze the Life cycle (or service life) information provided by the RFID tags 610, and to determine appropriate condition-based inspection, maintenance, and repairs of the various components of the aircraft 650. Thus, embodiments of the systems and methods in accordance with the present disclosure may be successfully and advantageously employed in a periodic manner (e.g. between flight operations), without the need for a global data transmission system 110 (FIG. 1).

While specific embodiments of the invention have been illustrated and described herein, as noted above, many changes can be made without departing from the spirit and scope of the invention. Accordingly, the scope of the invention should not be limited by the disclosure of the specific embodiments set forth above. Instead, the invention should be determined entirely by reference to the claims that follow.

What is claimed is:

1. A method for performing condition-based maintenance on a mechanical system, comprising:

providing a radio frequency identifier (RFID) tag on a component of the mechanical system;

sensing one or more operating conditions during operation of the mechanical system;

calculating a service life increment of the component based on the one or more operating conditions;

adjusting a service life value stored on the RFID tag of the components corresponding to the calculated service life increment;

after operation of the mechanical system has ceased, scanning the service life value stored on the RFID tag; and determining whether at least one of an inspection, a maintenance, and a repair of the component is needed based on the service life value.

2. The method of claim 1, wherein adjusting a service life increment stored on the RFID tag occurs at least one of after operation of the mechanical system has ceased and during operation of the mechanical system.

3. The method of claim 1, wherein calculating a service life increment of the component includes calculating a service life increment of the component using an onboard system located on the mechanical system.

4. The method of claim 1, wherein the mechanical system comprises a vehicle, and wherein sensing one or more operating conditions includes sensing one or more operating conditions during movement of the vehicle.

5. The method of claim 1, wherein the mechanical system comprises an aircraft, and wherein sensing one or more operating conditions includes sensing one or more conditions during flight of the aircraft.

6. The method of claim 5, wherein the sensing one or more operating conditions includes sensing at least one of aerodynamic conditions, loads, accelerations, and movements of the aircraft during flight.

7. The method of claim 6, wherein sensing one or more operating conditions includes sensing one or more operating conditions using an onboard system located on the aircraft, and wherein calculating a service life increment of the component includes calculating a service life increment of the component using a global data transmission system located off-board the aircraft, the global data transmission system operatively communicating with the onboard system to receive the one or more operating conditions.

8. The method of claim 7, wherein using a global data transmission system includes using at least one satellite, and wherein the global data transmission system operatively communicates with the onboard system via at least one Iridium communication component.

9. A method for performing condition-based maintenance, comprising:

providing a radio frequency identifier (RFID) tag on one or more components of a mechanical system;

operating the mechanical system;

receiving one or more operating conditions of the mechanical system;

adjusting a service life value of the one or more components based on the one or more operating conditions;

storing the adjusted service life value on the RFID tag of the one or more components;

analyzing the adjusted service life value stored on the RFID tag of the one or more components; and performing at least one of an inspection, a maintenance task, and a repair of at least some of the one or more components based on the adjusted service life value.

10. The method of claim 9, wherein storing the adjusted service life value on the RFID tag occurs at least one of after the mechanical system has ceased operating and while the mechanical system is still operating.

11. The method of claim 9, wherein adjusting a service life value includes calculating a service life increment of the component using an onboard system located on the mechanical system.

12. The method of claim 9, wherein the mechanical system comprises an aircraft, and wherein sensing one or more operating conditions includes sensing at least one of aerodynamic conditions, loads, accelerations, and movements of the aircraft during flight of the aircraft; and adjusting a service life value of the one or more components includes calculating a service life increment for each of the one or more components using a global data transmission system located off-board the aircraft.

13. The method of claim 12, wherein using a global data transmission system includes using at least one satellite.

14. A mechanical system, comprising:

a plurality of components operatively coupled to perform a desired operation;

a plurality of radio frequency identifier (RFID) tags, each RFID tag being affixed to a corresponding one of the plurality of components;

a measurement system configured to sense one or more operating conditions of the mechanical system;

an onboard system in operative communication with the plurality of measurement devices, the onboard system including:

an RFID interface component configured to communicate radio frequency (RF) signals with the plurality of RFID tags;

a processor configured to receive a Life cycle value for each of the plurality of components from the RFID interface, and to receive the one or more operating conditions sensed by the measurement system, the processor being further configured to execute instructions to:

calculate a Life cycle increment for each of the plurality of components based on the one or more operating conditions;

adjust the Life cycle value of each of the plurality of components; and store the adjusted Life cycle value on the corresponding RFID tag for each of the plurality of components via the RFID interface component.

15. The system of claim 14, wherein the onboard system further includes a communication component configured to operatively communicate with an off-board monitoring system.

16. The system of claim 15, wherein the mechanical system comprises an aircraft and the one or more operating conditions include one or more flight conditions.

17. The system of claim 16, wherein the communication component includes an Data Transmission System configured to operatively communicate with a satellite of the off-board monitoring system.

18. The system of claim 16, wherein the off-board monitoring system includes a server configured as an Aircraft Communication Addressing and Reporting System (AGARS) server.

19. The system of claim 16, wherein the measurement system includes at least one of a guidance and navigation system, a global positioning system, a six-degree of freedom motion detection system, a three axis accelerometer, a strain measurement system and a gyroscopic device.

* * * * *